US006024412A

United States Patent [19]

Kain et al.

[11] Patent Number: 6,024,412

[45] Date of Patent: Feb. 15, 2000

[54] TRAY ASSEMBLY WITH CROTCH POST

[75] Inventors: James M. Kain, Tipp City, Ohio; Michael S. Rosko, Greenwood, Ind.

[73] Assignee: Cosco, Inc., Columbus, Ind.

[21] Appl. No.: 09/092,126

[22] Filed: Jun. 5, 1998

Related U.S. Application Data

[60] Provisional application No. 60/048,780, Jun. 6, 1997.

[51] Int. Cl.[7] ..... A47C 31/00

[52] U.S. Cl. ..... 297/467; 297/153; 297/149

[58] Field of Search ..... 297/467, 135, 297/148, 151, 149, 153, 256.15, 250.1; 108/157.11, 50.11

[56] References Cited

U.S. PATENT DOCUMENTS

| | | |
|---|---|---|
| D. 365,936 | 1/1996 | Haut et al. . |
| 2,544,760 | 3/1951 | Johnson . |
| 2,687,167 | 8/1954 | Janesick . |
| 2,934,135 | 4/1960 | Lesh . |
| 4,807,928 | 2/1989 | Cone . |
| 5,238,292 | 8/1993 | Golenz et al. . |
| 5,326,327 | 7/1994 | Stephens et al. . |
| 5,334,099 | 8/1994 | Marra et al. . |
| 5,507,550 | 4/1996 | Maloney . |
| 5,527,090 | 6/1996 | Cone, II . |
| 5,593,207 | 1/1997 | Turner . |
| 5,810,432 | 9/1998 | Haut et al. . |

OTHER PUBLICATIONS

Century Products Company, Model No. 16–710, Catalogue (1997).

Graco Children's Products, Inc., Model No. 3170AM, Catalogue (1997).

Graco Children's Products, Inc., Model No. 3835SH, Catalogue (1997).

Graco Children's Products, Inc., "Adjustable High Chair", Model No. 3620AN, Catalogue (1997).

Kolcraft Enterprises, Inc., Model No. 19510 BK, Catalogue (1995).

Kolcraft Enterprises, Inc., "Perfect Recliner", Model No. 19518, Catalogue (1996).

Playskool, Inc., "1–2–3 High Chair", Model No. 30737, Catalogue (1997).

*Primary Examiner*—Milton Nelson, Jr.

*Attorney, Agent, or Firm*—Barnes & Thornburg

[57] ABSTRACT

A tray assembly comprises a tray, a crotch post, and a pivot post interconnecting the tray and the crotch post. The pivot post defines a fixed axis to enable pivotal movement of the crotch post about the fixed axis between an extended position wherein the crotch post extends at an angle away from the tray and a retracted position wherein the crotch post is positioned to lie adjacent to the tray.

77 Claims, 7 Drawing Sheets

TRAY ASSEMBLY WITH CROTCH POST

This Appln claims benefit of Provisional Appln No. 60/048,780 Jun. 6, 1997.

BACKGROUND AND SUMMARY OF THE INVENTION

The present invention relates to tray assemblies for seats, and particularly, to a tray assembly having a crotch post for use on a juvenile chair or a high chair. More particularly, the present invention relates to a removable tray assembly having a crotch post.

Tray assemblies are traditionally used with juvenile seats, juvenile chairs, and/or high chairs to provide a platform on which a caregiver can place items for a child such as food, toys, and so forth. See, for example, U.S. Pat. Nos. 4,807,928 to Cone and 5,527,090 to Cone. Some tray assemblies are adapted to be mounted to a seat having a crotch post molded therein. See, for example, U.S. Pat. No. Des. 365,936 to Haut et al.

According to the present invention, a seat and tray assembly is provided that includes a seat and a tray assembly selectively mounted to the seat. The tray assembly includes a tray and a crotch post mounted to the tray. The crotch post is configured for movement relative to the tray between an extended position wherein the crotch post extends at an angle away from the tray and a retracted position wherein the crotch position is adjacent to the tray.

The seat includes a seat bottom with a channel formed therein. The crotch post includes a foot portion sized to extend into the channel. The foot portion cooperates with the channel to inhibit movement between the crotch post and the seat bottom.

The crotch post is mounted to the tray and formed for pivotal movement about a pivot point. The crotch post includes a front surface, an opposite back surface, and a bottom surface extending therebetween. The back surface includes a flat surface and a cam surface. Upon placement of the tray assembly on a flat surface such as a counter top, the cam surface enables the crotch post to pivot towards the retracted position.

Additional features of the present invention will become apparent to those of ordinary skill of the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
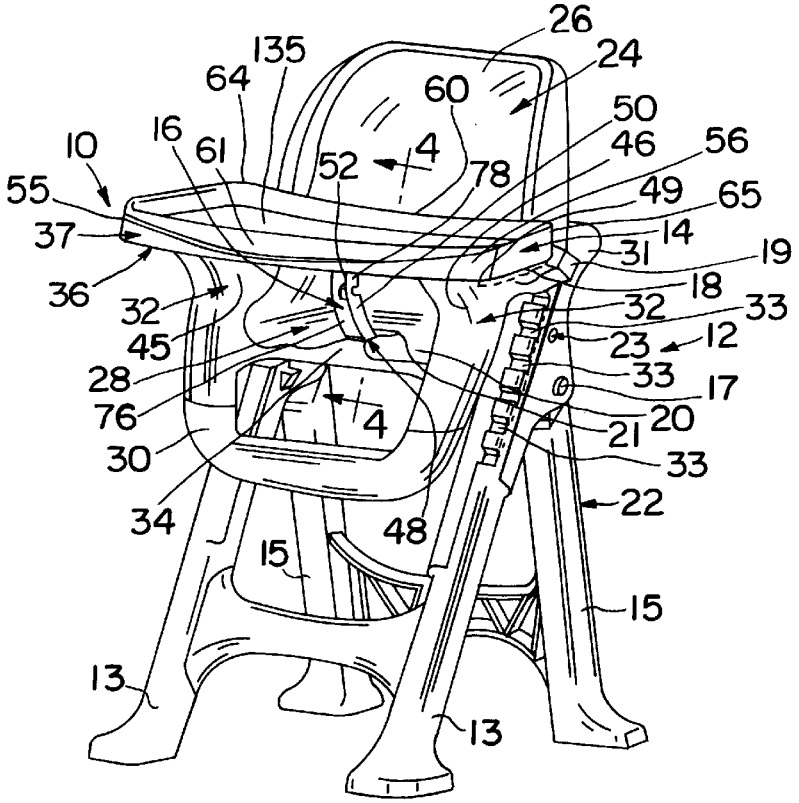
FIG. 1 is a perspective view of a tray assembly in accordance with the present invention mounted upon a juvenile chair including a frame and a seat mounted upon the frame, the seat having a seat back, a seat bottom, and arms positioned to lie on opposite ends of the seat bottom, and showing the tray assembly including a tray and a crotch post extending from the tray in an extended position such that the crotch post engages the seat bottom.
Figure 2:
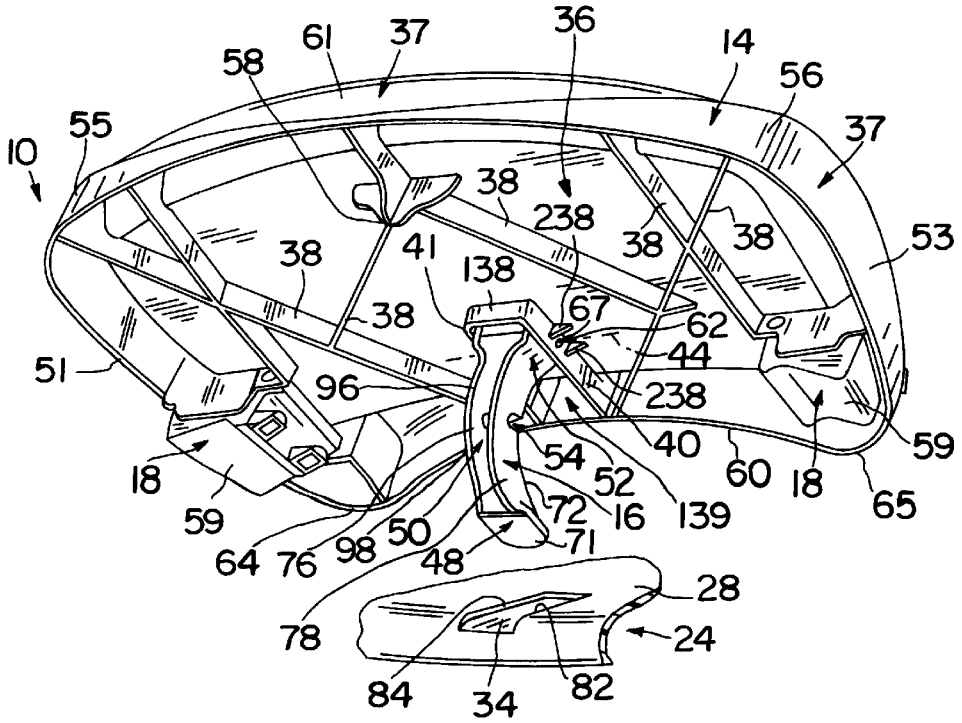
FIG. 2 is a perspective view of a portion of the seat bottom and a bottom side of the tray assembly of FIG. 1 showing the seat bottom including a channel and the crotch post including a foot portion sized for extension into the channel.
Figure 6:
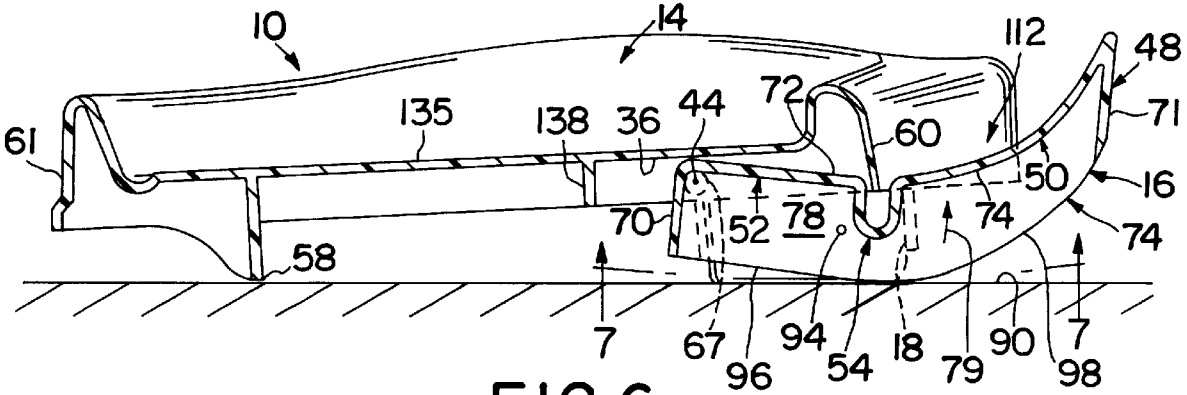
FIG. 6 is a view similar to FIG. 4 showing the tray assembly removed from the seat and situated upon a flat surface and the crotch post positioned to lie in a retracted position adjacent to the tray such that a top surface of the tray is positioned to lie in a generally upright position relative to the flat surface.

A tray assembly 10 exemplifying the present invention is shown in FIG. 1 as it would appear to a caregiver after it had been mounted onto a seat 24 of a juvenile chair 12. As shown in FIGS. 1–2, tray assembly 10 includes a tray 14, a pair of release mechanisms 18, and a crotch post 16 mounted to tray 14. Crotch post 16 is mounted to tray 14 for pivotal movement between an extended position 110 when tray assembly 10 is mounted to a juvenile seat 24 (FIG. 1), a hanging position 111 when tray assembly 10 is removed from seat 24 (FIG. 9), and a retracted position 112 when tray assembly 10 is placed on a flat surface 90 (FIG. 6). Thus, pivotable crotch post 16 allows tray assembly 10 to be removed from seat 24 and placed on a flat surface 90 out of reach of a juvenile sitting in seat 24. In addition, pivotable crotch post 16 allows seat 24 to be used with tray assembly 10 to secure a small child (or juvenile) in seat 24 or, as the child grows, tray assembly 10 can be removed so that seat 24 can be used as a booster seat (i.e., without tray assembly 10 and restrictive crotch post 16).

As shown in FIG. 1, tray assembly 10 is used with a juvenile chair 12 having a frame 22, seat 24 mounted upon frame 22, and a height-adjustment mechanism 19 formed to fix seat 24 in a pre-selected vertical position on frame 22. Frame 22 includes front legs 13 and rear legs 15 pivotably coupled to front legs 13 by pivot posts 17 and a latch 23. Front legs 13 include a plurality of height-position slots 33 to permit extension of height-adjustment mechanism 19 therein so that seat 24 can be held in a variety of elevated positions on frame 22. Front legs 13 also include a handle portion 31 extending between front legs 13 as shown in FIG.

1. Incorporated herein by reference are U.S. Pat. No. 5,527,090 to Cone II and U.S. Patent applications entitled "Juvenile Chair" to James M. Kain and Michael S. Rosko filed herewith and "Release Mechanism for Tray" to James M. Kain and Michael S. Rosko filed herewith.

Seat 24 is mounted on frame 12 and supports tray assembly 10. Seat 24 includes a seat bottom 28 formed to include a channel 34, a seat back 26 extending upwardly from seat bottom 28, and a pair of elevated arms 32 extending between seat bottom 28 and seat back 26 for supporting tray assembly 10. Channel 34 is defined by a pair of side walls 82, 84 and a bottom wall 85 formed in seat 24. As shown in FIG. 1, seat 24 includes a seat pad 20 positioned to lie upon seat bottom 28. Seat pad 20 conforms to the shape of seat 24 and includes a notch 21 that is sized to surround channel 34. Thus, seat pad 20 permits crotch post 16 to engage channel 34 as described below without interference from seat pad 20.

Arms 32 of seat 24 are configured to receive tray 14 thereon for locking tray assembly 10 onto seat 24. Arms 32 include an interior surface 45 extending from seat bottom 28, an opposite exterior surface 46, and a tray mount surface 47, shown in FIG. 4, extending between exterior and interior surfaces 46, 45. As shown in FIG. 1, exterior surface 46 is formed to include a plurality of tray-position slots 49 opening away from seat bottom 28. Slots 49 are sized to permit extension of release mechanisms 18 of tray assembly 10 therein so that tray assembly 10 can be held in a variety of positions on arms 32. It is understood that tray assembly 10 of the present invention can be used with a wide variety of seats, high chairs, or juvenile chairs in accordance with the present invention.

As shown in FIGS. 1 and 2 and mentioned above, tray assembly 10 includes tray 14, release mechanisms 18, and crotch post 16. Tray 14 includes a tray top 135, a tray bottom 36, and a perimeter surface 37 interconnecting tray top 135 and tray bottom 36. Perimeter surface 37 includes a convex outward edge 61, an opposite inward edge 60, opposite edges 51, 53 extending between first ends 55, 56 of outward edge 61 and first ends 64, 65 of inward edge 60, as shown in FIG. 2. Tray 14 further includes a pair of tabs (or mounting portion) 40, 41 that are formed integral with tray bottom 36 and are formed to include holes 62, 63 therethrough. Angled tabs 238 also extend from tabs 40, 41 to sandwich holes 62, 63 therebetween and to support tabs 40, 41. Tabs 40, 41 are also formed to include ramp sections or chamfers (not shown) so that crotch post 16 can be easily attached to tray 14 as described below. In addition, an end wall 138 connects opposing tabs 30, 41 to define a post-receiving cavity 139 sized to receive the crotch post 16 therein. As shown in FIG. 2, support members 38 and a stand-off nose 58 also extend from tray bottom 36 to provide structural support to tray 14.

Release mechanisms 18 of tray assembly 10 are mounted to tray bottom 36 of tray 14, as shown in FIG. 2. Release mechanisms 18 selectively mount tray assembly 10 to seat 24 by engaging tray-position slots 49. Thus, release mechanisms 18 cooperate with tray 14 hold tray assembly 10 in one of many predetermined positions on arms 32 of seat 24. It is understood that a wide variety of mechanisms may be used to mount tray assembly 10 of the present invention to a suitable seat or chair in accordance with the present invention.

Figure 7:
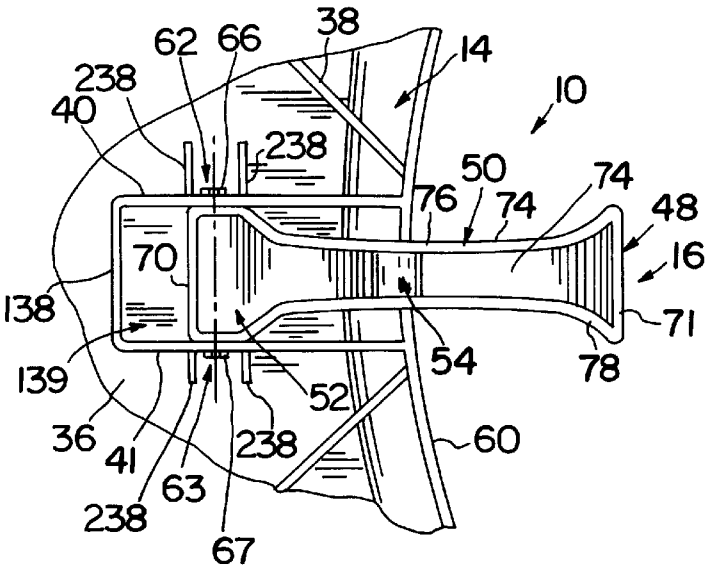
FIG. 7 is a view taken along line 7—7 of FIG. 6 with portions broken away showing the crotch post in the retracted position, the bottom side of the tray including tabs, the pivot posts of the hip portion extending through the tabs for pivotal movement of the crotch post relative to the tray, and the foot portion of the crotch post extending beyond an inward edge of the tray assembly when the crotch post is in the retracted position.
Figure 3:
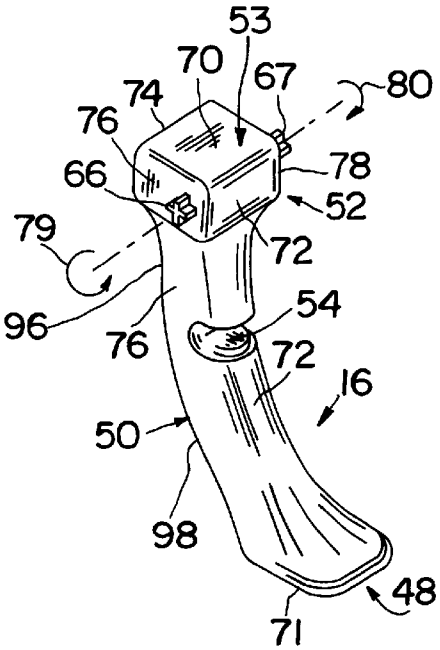
FIG. 3 is a perspective view of the crotch post of FIG. 2 showing the crotch post including a foot portion, a leg portion extending upwardly from the foot portion and having a notch formed therein, and a hip portion having spaced-apart pivot posts formed therein.

As shown in FIGS. 2 and 7, crotch post 16 of tray assembly 10 is mounted to tray bottom 36 of tray 14 within post-receiving cavity 13. Crotch post 16 is molded from a generally rigid plastic material. It is understood, however, that crotch post 16 may be constructed from a wide variety of materials in accordance with the present invention. Crotch post 16 includes a top surface 70, a bottom surface 71, and front, back, and side surfaces 72, 74, 76, 78 extending between the top and bottom surfaces 70, 71. Back surface 74 includes a flat surface 96 and a cam surface 98. As shown in FIGS. 2–3, crotch post 16 may be described to include a foot portion 48, a hip portion 52, and a leg portion 50 interconnecting foot portion 48 and hip portion 52. As shown in FIG. 3, hip portion 52 includes a base 53 and two pivot posts 66, 67 extending outwardly from base 53 in opposite directions. Leg portion 50 is formed to include a notch 54 in the front surface 72 thereof so that a portion of inward edge 60 of tray 14 can be received therein when crotch post 16 is in retracted position 112 as described below.

Referring now to FIGS. 3 and 7, crotch post 16 is mounted to tray bottom 36 by cross-shaped pivot posts 66, 67 that extend from side surfaces 76, 78. Pivot posts 66, 67 extend through holes 62, 63 formed in tabs 40, 41, as shown in FIG. 2, so that crotch post 16 can pivot between an extended position 110 (FIG. 4), a hanging position 111 (FIG. 9), and a retracted position 112 (FIG. 6). Ramp sections or chamfers (not shown) of tray 14 allow tabs 40, 41 to flex outwardly as pivot posts 66, 67 are being inserted through holes 62, 62. Once pivot posts 66, 67 have been extended through holes 62, 63, tabs 40, 41 flex back to their original position so that crotch post 16 cannot be easily removed from tray 14. End wall 138 interconnecting tabs 40, 41 provides sufficient rigidity to allow crotch post 16 to be inserted into holes 62, 63, while preventing crotch post 16 from easily being removed.

Figure 4:
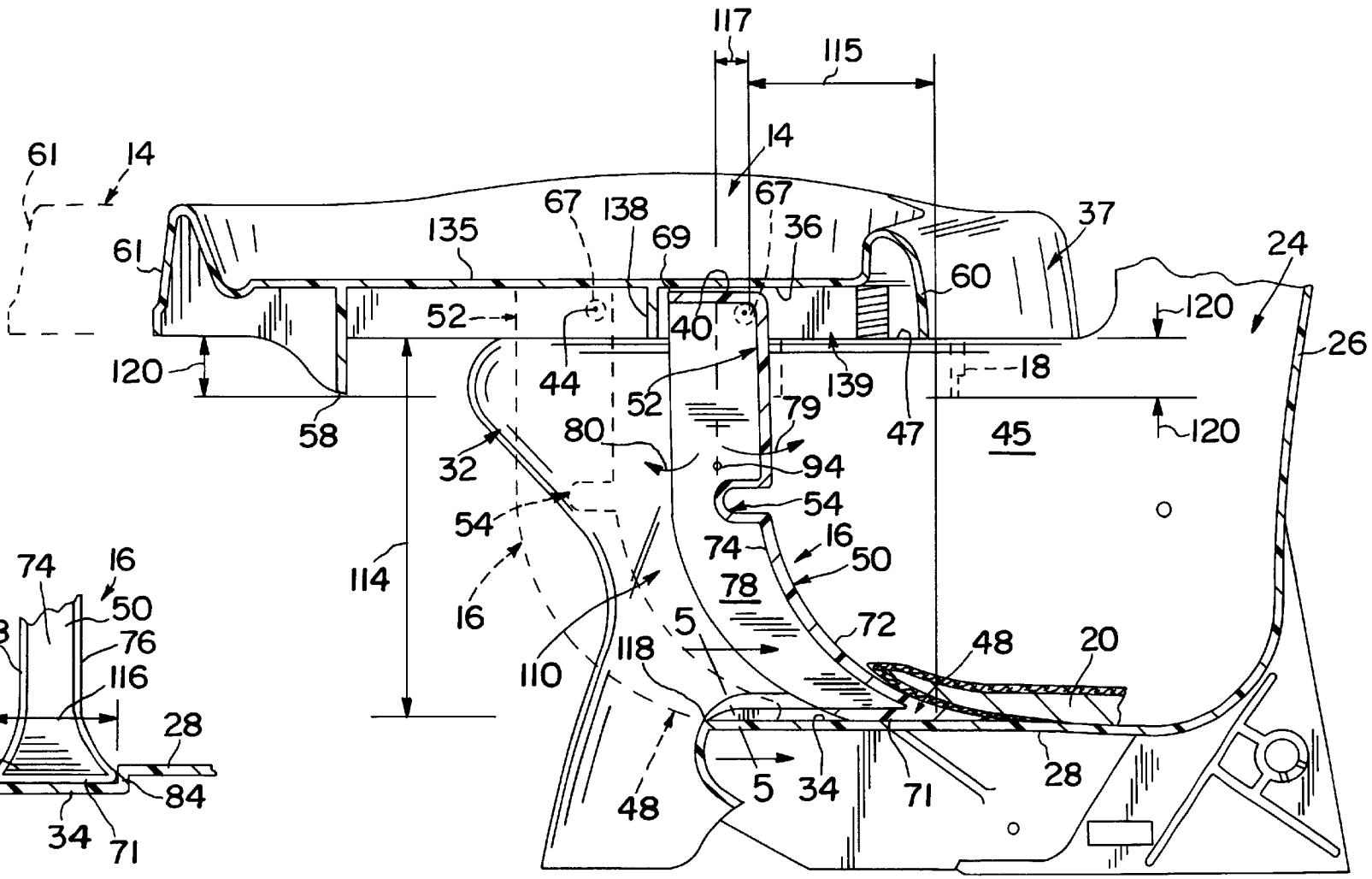
FIG. 4 is a view taken along line 4—4 of FIG. 1 showing the tray assembly mounted on the arms of the seat, the crotch post extending from the tray in an extended position wherein the foot portion of the crotch post is positioned to lie within the channel of the seat bottom.
Figure 5:
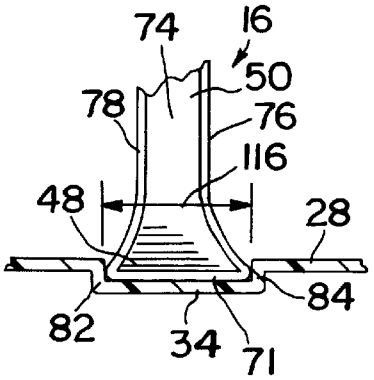
FIG. 5 is a view taken along line 5—5 of FIG. 4 showing a bottom surface of the foot portion engaging the channel formed in the seat bottom.

When tray assembly 10 is mounted to seat 24 as shown in FIG. 1, crotch post 16 is sandwiched between tray 14 and seat bottom 28 in expanded position 110. As shown in FIG. 4, the distance shown by arrow 114 between tray 14 and seat bottom 28 is such that crotch post 16 is prevented from pivoting relative to the tray top 14 when tray assembly 10 is mounted to seat 24. The distance shown by arrow 115 between foot portion 48 and pivot post 67 is such that a center of gravity 94 of crotch post 16 is offset by a distance shown by arrow 117 from pivot post 67, as shown in FIG. 4, when crotch post 16 is in the extended position. Center of gravity 94 shown in the figures is demonstrative of a possible location for the center of gravity. It is not beyond the scope of this invention for the center of gravity of the crotch post to be located in a variety of other positions. As shown in FIG. 5, channel 34 formed in seat bottom 28 of seat 24 prevents crotch post 16 from moving side-to-side when tray assembly 10 is mounted to seat 24. Specifically, channel 34 has a pre-determined dimension, as shown by arrow 116. Dimension 116 is approximately the same dimension as foot portion 48 so that foot portion 48 of crotch post 16 fits snugly in channel 34 between side walls 82, 84 to prevent crotch post 16 from moving side-to-side.

To mount crotch post 16 within channel 34, tray assembly 10 is positioned upon arms 32 so that foot portion 48 lies adjacent an outer edge 118 of seat portion 28 within channel 34, see in phantom, for example, in FIG. 4. At this time, hip portion 52 of crotch post 16 is positioned to lie generally perpendicular relative to tray bottom 36 wherein a back edge 69 of top wall 70 rests against tray bottom 36 of tray 14. Back edge 69 of top wall 70 prevents crotch post 16 from pivoting about an axis 44 beyond generally perpendicular in direction 80.

With crotch post 16 in this extended position 110, crotch post 16 is sized so that foot portion 48 of crotch post 16 will land in shallow channel 34 of seat bottom 28 of seat 24 when tray 14 is attached to seat 24 such that bottom surface 71 engages seat 24. Seat pad 20 is configured to allow a front edge of foot portion 48 to slide under pad 20 when tray 14 is mounted to seat 24. As shown in FIG. 5, channel 34 minimizes the side-to-side movement of crotch post 16 relative to seat bottom 28 of seat 24 because foot portion 48 of crotch post 16 is trapped between channel-defining side walls 82, 84. Side walls 82, 84 are formed in seat bottom 28 such that foot portion 48 of crotch post 16 will fit snugly in channel 34.

Figure 9:
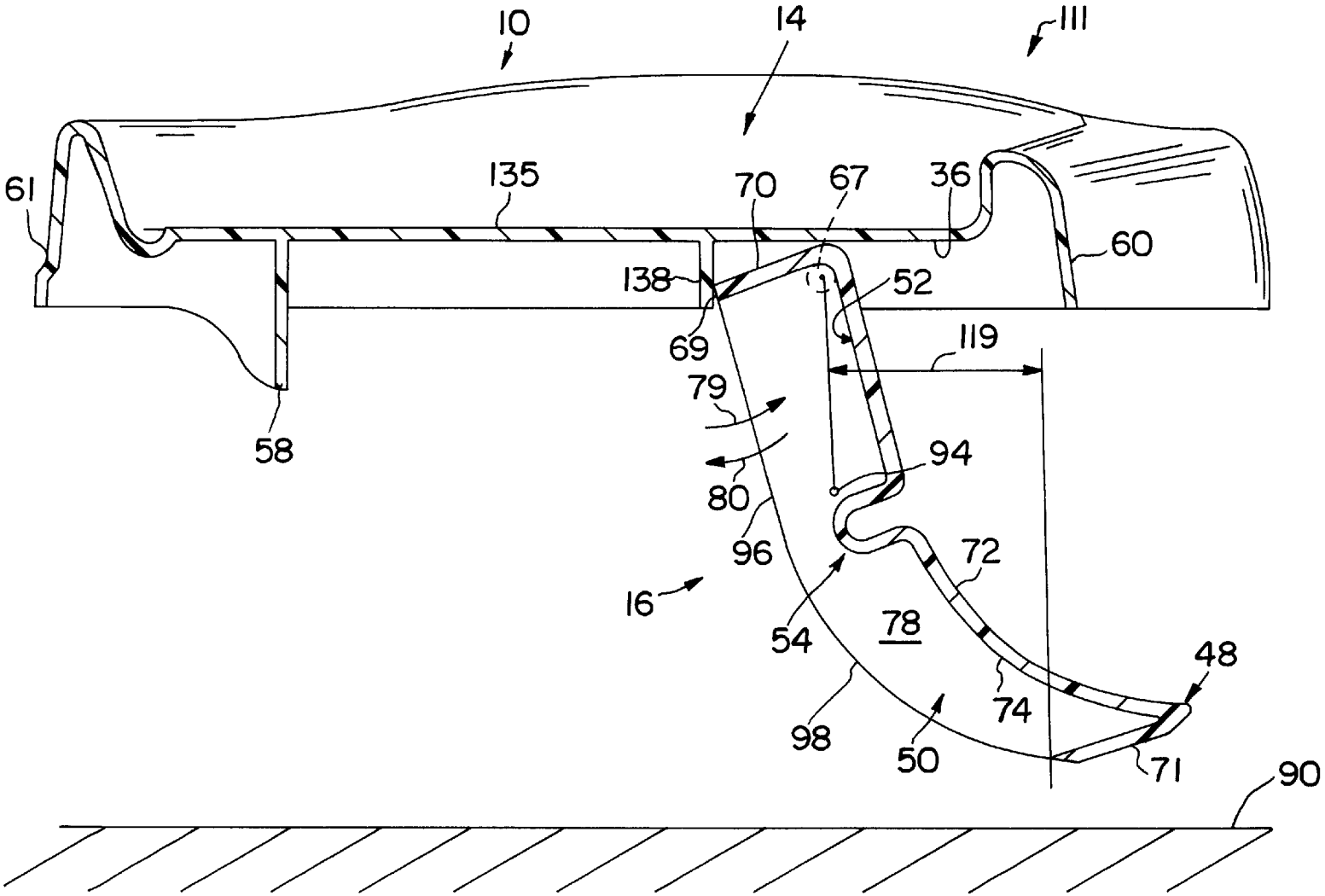
FIG. 9 is a view similar to FIG. 8 showing the crotch post in a hanging position when the crotch post engages neither the seat nor the flat surface.

As shown in FIG. 6, tray assembly 10 can be removed from seat 24 and placed on a flat surface 90 so that tray top 135 is positioned to lie generally parallel to flat surface 90. When tray assembly 10 is removed from seat 24, crotch post 16 pivots (or swings) from the extended position 110 (FIG. 4) to a hanging position 111 shown in FIG. 9. As shown in FIG. 9, crotch post 16 swings towards inward edge 60 because, in the extended position 110 of FIG. 4, foot portion 48 is offset from pivot post 67 by distance 115 and is offset from the center of gravity 94 of crotch post 16 by distance 115 plus distance 117. Then, when tray assembly 10 is removed from seat 24 foot portion 48 is no longer restricted by seat 24 and crotch post 16 is free to pivot so that the center of gravity 94 of crotch post 16 is in a vertical position relative to pivot post 67 as shown in FIG. 9.

Figure 8:
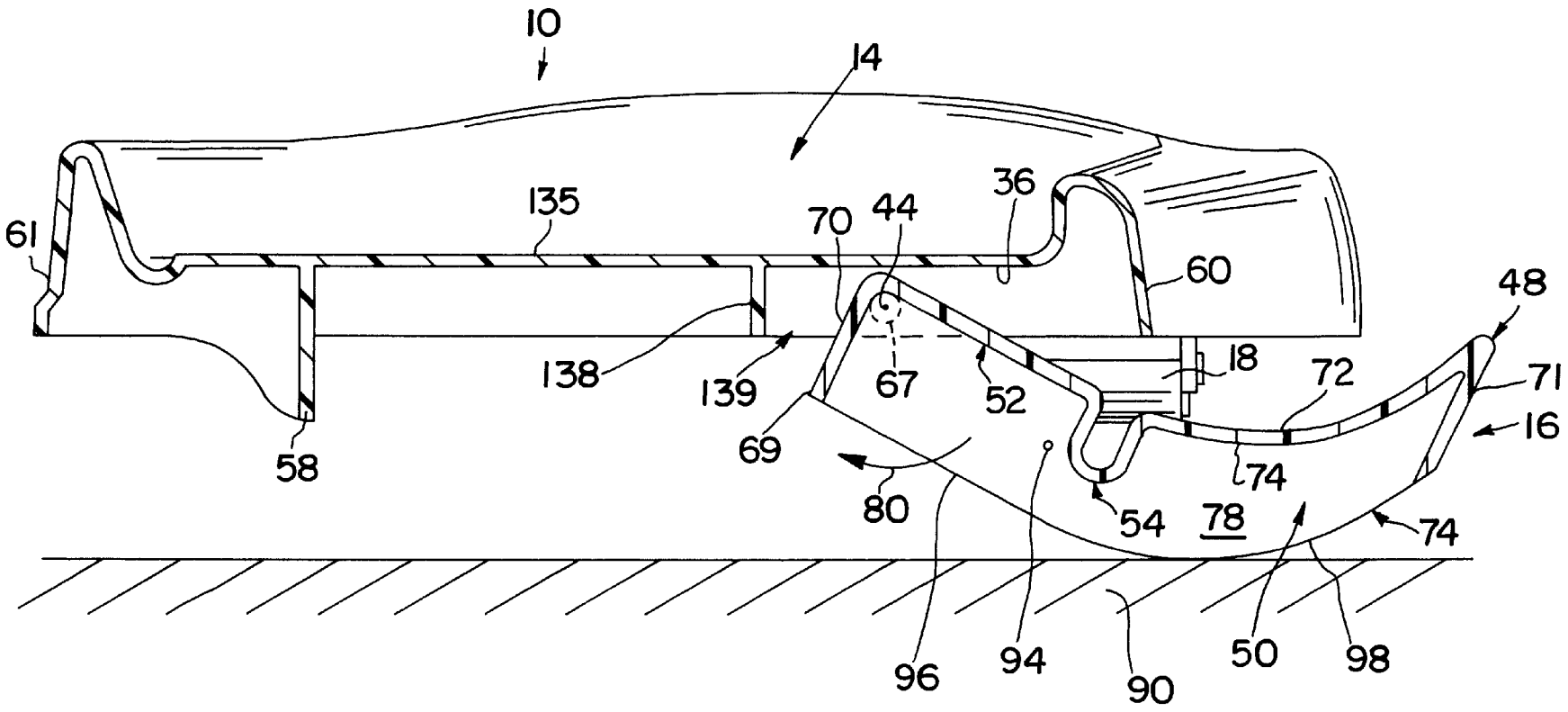
FIG. 8 is a view similar to FIG. 6 showing gravity-fed pivotable movement of the crotch post away from the tray upon manual lifting of the tray assembly away from the flat surface.

As shown in FIG. 9, in the hanging position 111, crescent-shaped crotch post 16 may be placed on a flat surface 90 without requiring further action by a caregiver. The caregiver simply needs to lay tray assembly 10 down on a flat surface 90 and crotch post 16 automatically pivots out of the way to a position adjacent to the tray 14 as shown in FIG. 6. This automatic pivoting is possible because foot portion 48 extends outwardly from leg portion 50 and does not block the pivoting action when tray assembly 10 is lowered vertically onto the flat surface. In addition, crotch post 16 is crescent shaped so that cam surface 98 of crotch post 16 engages a flat surface 90 as shown in FIG. 8 when tray assembly 10 is initially placed on flat surface 90. If pivot posts 66, 67 of crotch post 16 were to be positioned such that crotch post 16 hung exactly vertically so that bottom surface 71 of foot portion 48 hit flat surface 90 first (instead of cam surface 98), the caregiver would have to perform an additional step (such as manually pivoting crotch post 16 towards inward edge 60) prior to placing tray assembly 10 on flat surface 90. When tray assembly 10 is placed on flat surface 90, crotch post 16 pivots in direction 79 so that cam surface 98 causes crotch post 16 to continue to pivot. Crotch post 16 continues to pivot until flat surface 96 of back surface 74 is flat upon surface 90 or tray assembly 10 is supported by means other than the crotch post 16. Eventually, crotch post 16 pivots so that front surface 72 of crotch post 16 engages tray 14. At this time, crotch post 16 is in the retracted position 112 so that crotch post 16 extends substantially parallel relative to tray bottom 36 or tray top 135 and is adjacent to tray 14.

In the retracted position 112, crotch post 16 does not support tray 14 on flat surface 90 and hip portion 52 and foot portion 48 are, in fact spaced-apart from flat surface 90. Tray assembly 10 instead provides a three-point support system that includes stand-off nose 58 and release mechanisms 18 to support tray 14. Nose 58 and release mechanisms 18 extend from tray bottom 36 a predetermined distance 120 that is greater that the height of side walls 76, 78 of crotch post 16. When tray assembly 10 is lowered onto flat surface 90, cam surface 98 of crotch post 16 hits flat surface 90 first and pivots about axis 44 towards inward edge 60 of tray 14. Cam surface 98 continues to engage flat surface 90 until flat surface 96 of crotch post 16 engages flat surface 90. When the three-point support system of stand-off nose 58 and release mechanisms 18 fully support the weight of tray assembly 10, flat surface 96 engages flat surface 90. Back surface 74 of crotch post 16 does not support the weight of tray assembly 10 in retracted position 112, although it is not beyond the scope of this invention for crotch post 16 or any other portion of tray assembly 10 to serve as one of the three support members 38.

Notch 54 formed in crotch post 16 allows inward edge 60 of tray 14 not to interfere with the pivoting action of crotch post 16. As shown in FIG. 6, notch 54 receives inward edge 60 of tray 14 when crotch post 16 is in retracted position 112. As shown in FIGS. 6 and 7, side surfaces 76, 78 are configured to engage surface 90 when tray assembly 10 is placed on surface 90 to prevent further pivoting movement of crotch post 16 toward expanded position 110.

In FIG. 8, tray assembly 10 is shown as it would appear in the process of lifting tray assembly 10 off of generally flat surface 90. As shown in FIG. 8, gravity causes crotch post 16 to pivot in the direction of arrow 80 about axis 44 when tray assembly 10 is lifted off of flat surface 90. When tray assembly 10 is lifted completely off of flat surface 90 such that crotch post 16 is no longer touching flat surface 90, crotch post 16 pivots to the hanging position 111 as shown in FIG. 4 so that tray assembly 10 is ready to be installed onto seat 24 of juvenile chair 12.

Figure 10:
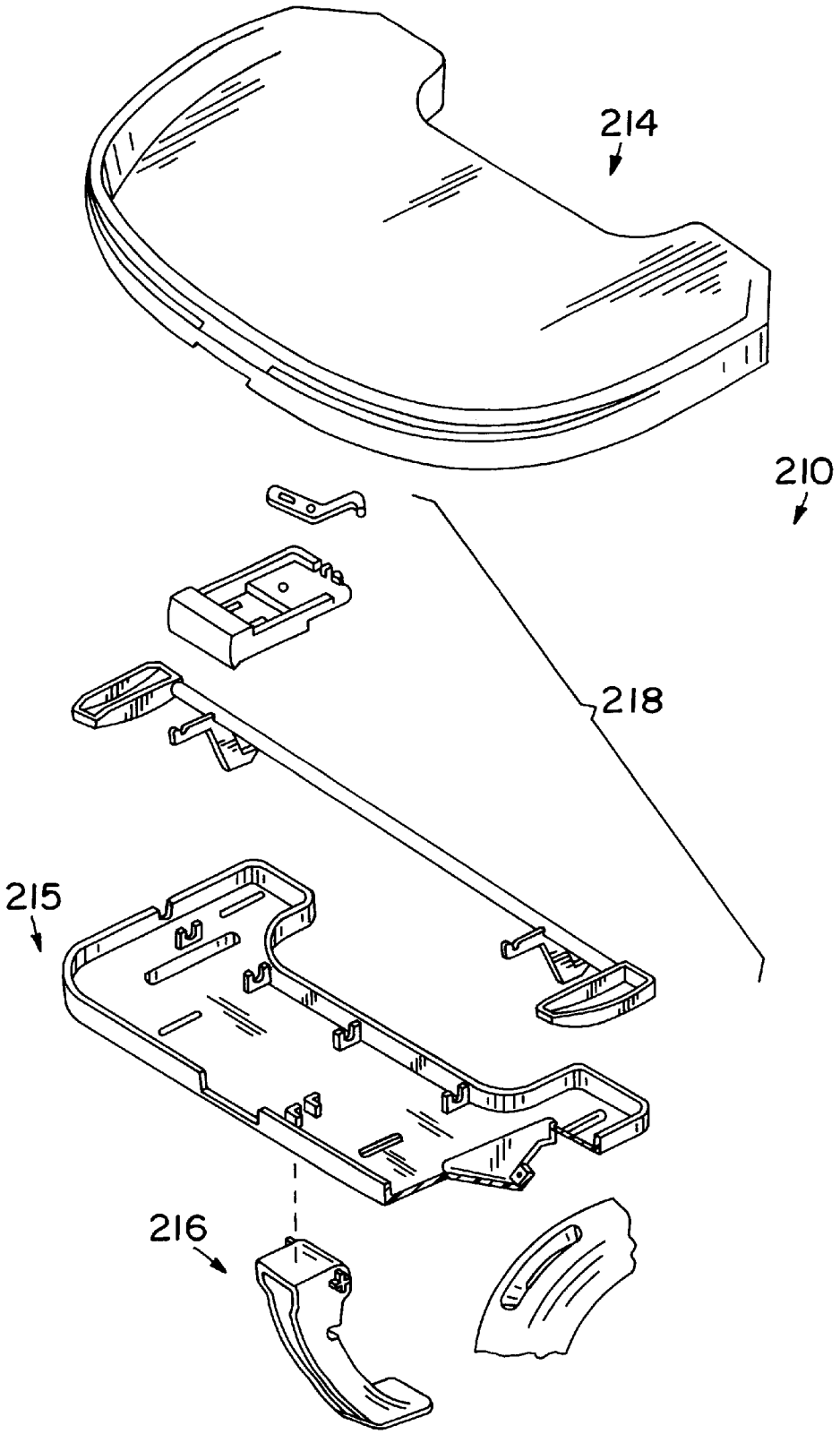
FIGS. 10–12 show the crotch post coupled to a tray assembly having a tray and a base.
Figure 11:
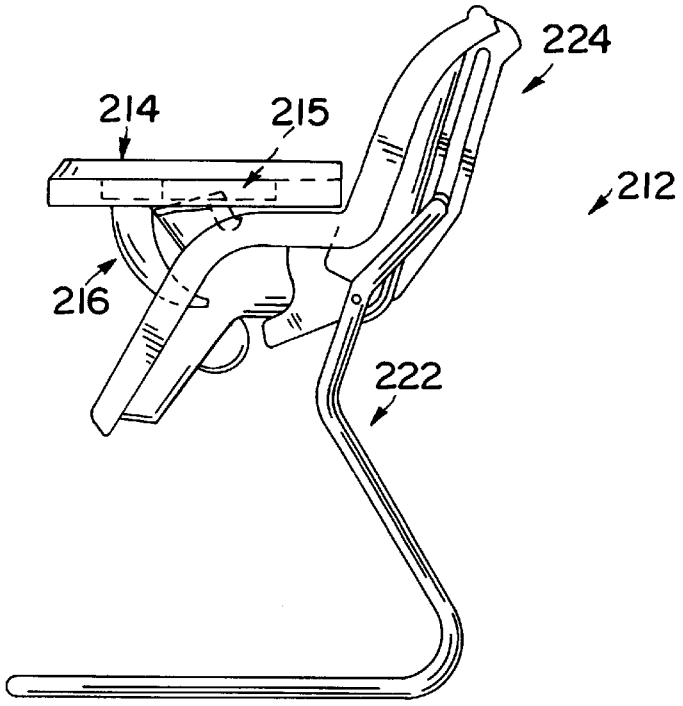
Figure 12:
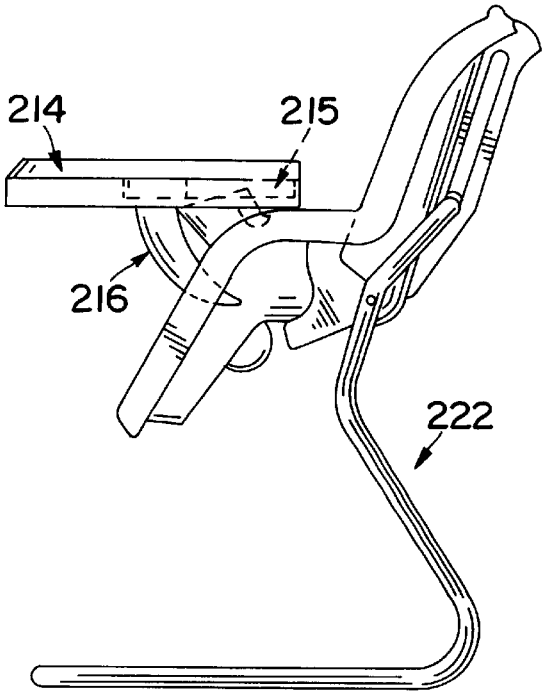

The crotch post of the present invention can be coupled to a variety of different tray assemblies or trays typically used for high chairs or juvenile chairs. As shown in FIGS. 10–12, a crotch post 216 is coupled to a tray assembly 210 having a tray 214 and a base 215. Tray 214 can be coupled to base 215 using a coupling mechanism 218. Coupling mechanism 218 allows tray 214 to move relative to base 215. Crotch post 216 can be coupled to base 215 so that when base 215 is mounted to a seat 224 as shown in FIGS. 11 and 12, tray 214 can be movable upon base 215 without disrupting the positioning of crotch post 216 relative to seat 224. U.S. Pat. No. 5,527,090 to Cone II provides a more detailed description of the operation of this type of tray assembly. In addition, although seat 224 is shown to be mounted on a frame 222 to define a high chair 212 in FIGS. 10–12, it is understood that the crotch post of the current invention can be used on a wide variety of trays and tray assemblies that are typically used for high chairs or juvenile chairs.

Although the invention has been described in detail with reference to certain preferred embodiments, variations and modifications exist within the scope and spirit of the invention as described and defined in the following claims.

What is claimed is:

1. A tray assembly adapted to be mounted on a seat, the tray assembly comprising a tray having a top surface, an opposite bottom surface, and latches coupled to the bottom surface, and a generally rigid crotch post including a hip portion having a pair of pivot posts coupled to the tray to enable pivotal movement about a fixed axis between an extended position wherein the crotch post extends downwardly from the bottom surface of the tray and a retracted position wherein the crotch post is positioned to lie adjacent to the bottom surface of the tray.

2. The tray assembly of claim 1, wherein the tray includes support members extending from the bottom surface a predetermined distance, the crotch post includes side wall having a predetermined dimension, and the predetermined distance is greater than the predetermined dimension.

3. The tray assembly of claim 1, wherein the crotch post is further formed to include a leg portion extending from the hip portion and the leg portion includes a notch that is positioned to receive the tray therein when the crotch post is in the retracted position.

4. The tray assembly of claim 1, wherein the tray includes spaced apart tabs extending from the bottom surface to define a post-receiving cavity therebetween and the pivot posts are coupled to the tabs and the crotch post is positioned to lie within the cavity.

5. The tray assembly of claim 4, wherein the tray includes an outward edge, an opposite inward edge, and opposite side edges extending between outward and inward edges and the crotch post is positioned to lie between the opposite side edges.

6. The tray assembly of claim 1, wherein the hip portion of the crotch post extends generally perpendicular from the bottom surface of the tray when the crotch post is in the extended position.

7. The tray assembly of claim 6, wherein the hip portion of the crotch post is positioned to lie generally parallel to the bottom surface of the tray when the crotch post is in the retracted position.

8. The tray assembly of claim 1, wherein the hip portion further includes a base and the pivot posts extend outwardly from the base.

9. The tray assembly of claim 8, wherein one of the pivot posts extends in a first direction and the other pivot post extends in a direction opposite the first direction.

10. The tray assembly of claim 1, wherein the crotch post includes a foot portion and a leg portion interconnecting the hip and foot portions, the foot portion being offset by a predetermined distance from an axis extending between the pivot posts and a center of gravity of the crotch post.

11. The tray assembly of claim 10, wherein the crotch post is crescent shaped.

12. A seat and tray assembly comprising a seat having a seat bottom formed to include a channel in a top surface of the seat bottom and a seat back extending from the seat bottom, and a tray assembly mounted on the seat, the tray assembly including a tray and a crotch post coupled to the tray for movement relative to the tray, the crotch post having a foot portion extending into the channel of the seat when the tray assembly is mounted to the seat.

13. The seat and tray assembly of claim 12, wherein the crotch post is formed for movement between an extended position when the crotch post engages the channel of the seat and a retracted position when the tray is removed from the seat and the crotch post is positioned to lie adjacent to the tray.

14. The seat and tray assembly of claim 13, wherein the crotch post includes a hip portion coupled to the tray and an opposite foot portion that has a generally flat bottom surface and the bottom surface engages the channel when the crotch post is in the extended position.

15. The seat and tray assembly of claim 14, wherein the tray includes a top surface and an opposite bottom surface and the hip portion of the crotch post includes a top surface that is positioned to lie generally parallel to the bottom surface when the crotch post is in the extended position.

16. The seat and tray assembly of claim 14, wherein the hip portion includes front and back surfaces and opposite sides extending from the top surface and pivot posts extending from the opposite sides.

17. The seat and tray assembly of claim 16, wherein the pivot posts are positioned to lie adjacent to the front surface of the hip portion.

18. The seat and tray assembly of claim 13, wherein the crotch post is constructed of a generally rigid plastic material.

19. The seat and tray assembly of claim 12, further comprising a frame and the seat is mounted on the frame.

20. The seat and tray assembly of claim 19, wherein the tray assembly further includes a pair of release mechanisms mounted to the tray to lock the tray assembly to the seat.

21. The seat and tray assembly of claim 20, wherein the tray includes a stand-off nose that cooperates with the release mechanisms to support the tray when the tray is removed from seat and the crotch post is positioned to lie adjacent to the tray in a retracted position.

22. A seat and tray assembly comprising a seat having a seat bottom formed to include a channel thereon and a seat back extending from the seat bottom, and a tray assembly mounted on the seat, the tray assembly including a tray and a crotch post coupled to the tray for movement relative to the tray, the crotch post having a foot portion extending into the channel formed on the seat bottom when the tray assembly is mounted to the seat, the crotch post including a hip portion having a pivot post pivotably coupled to the tray, an opposite foot portion, and a leg portion interconnecting the hip and foot portions, the foot portion being offset by a predetermined distance from an axis extending between the pivot post and a center of gravity of the crotch post.

23. A juvenile chair comprising a frame, a seat mounted to the frame and including a seat bottom and a seat back extending upwardly from the seat bottom, a tray having a tray bottom formed integral with a mounting portion and being formed to be movable between a mounted position wherein the tray is mounted to the seat and a removed position wherein the tray is removed from the seat, and a crotch post mounted to the mounting portion of the tray for pivotable movement between an extended position wherein the crotch post extends between the tray and the seat bottom when the tray is in the mounted position and a retracted position wherein the crotch post is adjacent to the tray.

24. The chair of claim 23, wherein the seat bottom is formed to include a channel and the crotch post extends into the channel when the crotch post is in the extended position.

25. The chair of claim 24, wherein the crotch post is formed to include a notch that receives the tray therein when the crotch post is in the retracted position.

26. The chair of claim 23, wherein the tray includes support members extending from the tray a predetermined distance and the crotch post includes side walls having a predetermined dimension, and the predetermined distance is greater than the predetermined dimension.

27. The chair of claim 23, wherein the crotch post includes a hip portion having a pivot post pivotably coupled to the tray, an opposite foot portion, and a leg portion interconnecting the hip and foot portions, the foot portion being offset by a predetermined distance from an axis extending between the pivot post and a center of gravity of the crotch post.

28. The chair of claim 23, wherein the tray includes a top surface, an opposite bottom surface, and spaced apart tabs extending from the bottom surface to define a post-receiving cavity therebetween and the crotch post is coupled to the tabs and positioned to lie within the cavity.

29. The chair of claim 28, wherein the crotch post includes a top surface positioned to lie adjacent to the bottom surface of the tray when the crotch post is in the extended position.

30. A juvenile chair comprising a frame, a seat mounted to the frame and including a seat bottom and a seat back extending upwardly from the seat bottom, a tray formed to be movable between a mounted position wherein the tray is mounted to the seat and a removed position wherein the tray is removed from the seat, and a crotch post mounted to the tray for pivotable movement between an extended position wherein the crotch post extends between the tray and the seat bottom when the tray is in the mounted position and a retracted position wherein the crotch post is adjacent to the tray, wherein the seat bottom is formed to include a channel and the crotch post extends into the channel when the crotch post is in the extended position, the crotch post is formed to include a notch that receives the tray therein when the crotch post is in the retracted position, and the crotch post includes a generally curved leg portion and the notch is formed in the leg portion.

31. The chair of claim 30, wherein the tray includes a top surface and an opposite bottom surface and the notch is positioned to face the bottom surface when the crotch post is in the retracted position.

32. A tray assembly comprising a tray having latches coupled thereto, a crotch post, and means for mounting the crotch post to the tray for movement of the crotch post relative to the tray between an extended position wherein the crotch post extends at an angle away from the tray and a retracted position wherein the crotch post is adjacent to the tray, the mounting means including a first pivot post extending from the crotch post in a first direction and a second pivot post extending from the crotch post in a direction opposite the first direction.

33. The tray assembly of claim 32, wherein the tray includes a top surface, a bottom surface, and the crotch post is mounted to the bottom surface of the tray.

34. The tray assembly of claim 33, wherein the tray includes an outward edge, an opposite inward edge, and opposite side edges interconnecting outward and inward edges and the crotch post is positioned to lie between the opposite side edges.

35. The tray assembly of claim 33, wherein the bottom surface of the tray includes support members that extend away from the bottom surface a predetermined distance, the crotch post includes side walls having a predetermined dimension, and the predetermined distance is greater then the predetermined dimension so that the support members extend past the crotch post when the crotch post is in the retracted position.

36. The tray assembly of claim 32, wherein the crotch post includes a hip portion having a pivot post pivotably coupled to the tray, an opposite foot portion, and a leg portion interconnecting the hip and foot portions, the foot portion being offset by a predetermined distance from an axis extending between the pivot post and a center of gravity of the crotch post.

37. The tray assembly of claim 32, wherein the crotch post includes a base having opposite side surfaces and the first pivot post extends from one of the side surfaces and the second pivot post extends from the other side surface.

38. The tray assembly of claim 37, wherein the pivot posts are cross-shaped.

39. The tray assembly of claim 37, wherein the base further includes a bottom surface and the crotch post includes a leg portion extending from the bottom surface and positioned to lie between the pivot posts.

40. A tray assembly adapted to be mounted on a seat, the tray assembly comprising a tray having a top surface, an opposite bottom surface, and latches coupled to the bottom surface, and a generally rigid crotch post coupled to the bottom surface of the tray and formed for pivotal movement between an extended position wherein the crotch post extends downwardly from the bottom surface of the tray and a retracted position wherein the crotch post is positioned to lie adjacent to the bottom surface of the tray, wherein the tray includes support members extending from the bottom surface a predetermined distance, the crotch post includes side walls having a predetermined dimension, and the predetermined distance is greater than the predetermined dimension, the support members cooperating to define a three-point support system that includes a stand-off nose and spaced apart tray-release mechanisms.

41. A tray assembly comprising a tray and a crotch post including at least one pivot post rotatably coupled to the tray to enable pivotal movement of the crotch post between an extended position wherein the crotch post extends at an angle away from the tray and a retracted position wherein the crotch post is adjacent to the tray, wherein the tray includes a hip portion having pivot posts that couple to the tray, the hip portion of the crotch post extends generally perpendicular from a bottom surface of the tray when the crotch post is in the extended position.

42. A tray assembly comprising a tray and a crotch post coupled to the tray and formed for pivotal movement about a fixed axis between an extended position wherein the crotch post extends at an angle away from the tray and a retracted position wherein the crotch post is adjacent to the tray.

43. The tray assembly of claim 42, wherein the crotch post includes a front surface facing toward the tray and an opposite back surface facing away from the tray, the back surface including a cam surface.

44. The tray assembly of claim 43, wherein the crotch post further includes a top surface and a bottom surface, the top and bottom surfaces extending between the front and back surfaces and positioned to lie perpendicular to one another.

45. The tray assembly of claim 42, wherein the crotch post includes a cam surface adapted to engage a counter surface to move the crotch post from the extended position to the retracted position upon downward movement of the tray toward such counter surface while the crotch post lies between the tray and such counter surface.

46. The tray assembly of claim 42, wherein the tray includes a hip portion having pivot posts that couple to the tray.

47. The tray assembly of claim 46, wherein the hip portion of the crotch post is positioned to lie generally parallel to a bottom surface of the tray when the crotch post is in the retracted position.

48. A tray assembly comprising a tray having latches coupled thereto, a crotch post, and means for mounting the crotch post to the tray for movement of the crotch post relative to the tray between an extended position wherein the crotch post extends at an angle away from the tray and a retracted position wherein the crotch post is adjacent to the tray, wherein the crotch post includes a hip portion, an opposite foot portion, and a leg portion extending between the hip and foot portions, the leg portion being formed to include a notch positioned to lie in coextensive relation to the inward edge of the tray such that the inward edge of the tray is received into the notch when the crotch post is in the retracted position.

49. The tray assembly of claim 48, wherein the hip portion of the crotch post extends generally perpendicular relative to the bottom surface of the tray in the extended position.

50. The tray assembly of claim 48, wherein the hip portion of the crotch post extends generally parallel relative to the bottom surface in the retracted position.

51. A seat and tray assembly comprising a seat including a seat bottom and a seat back extending from the seat bottom and a tray assembly mounted on the seat, the tray assembly including a tray and a crotch post coupled to the tray for pivotal movement therewith about a fixed axis.

52. The seat and tray assembly of claim 51, wherein the crotch post has a foot portion engaging the seat bottom when the tray assembly is mounted to the seat.

53. The seat and tray assembly of claim 52, wherein the tray includes an inward edge facing the seat back and an opposite outward edge and the foot portion is positioned to lie spaced apart from the tray when the foot portion engages the seat bottom.

54. The seat and tray assembly of claim 52, wherein the crotch post includes a hip portion coupled to the tray and a leg portion extending between the hip and foot portions.

55. The seat and tray assembly of claim 54, wherein the leg portion includes a generally concave front surface facing the seat back when the foot portion engages the seat bottom.

56. The seat and tray assembly of claim 54, wherein the tray includes an inward edge facing the seat back and an opposite outward edge and the leg portion is formed to include a notch sized to receive the inward edge therein when the crotch post is in a retracted position.

57. The seat and tray assembly of claim 54, wherein the leg portion includes a generally convex surface facing away from the seat back when the foot portion engages the seat bottom.

58. A tray assembly comprising a tray and a crotch post including a hip portion and a leg portion extending from the hip portion, the hip portion having a base and a pivot post extending outwardly from the base in a first direction, the pivot post being coupled to the tray to enable pivotal movement about a fixed axis between an extended position wherein the crotch post extends at an angle away from the tray and a retracted position wherein the crotch post is positioned to lie adjacent to the tray.

59. The tray assembly of claim 58, wherein the hip portion further includes a second pivot post extending in a direction opposite the first direction.

60. The tray assembly of claim 59, wherein the tray includes a tray bottom molded to be integral with a mounting portion and the pivot posts engage the mounting portion.

61. The tray assembly of claim 60, wherein the pivot posts are cross-shaped.

62. The tray assembly of claim 58, wherein the leg portion includes a notch formed in the front surface thereof.

63. A tray assembly comprising a tray, a crotch post, and a pivot post interconnecting the tray and the crotch post and defining a fixed axis to enable pivotal movement of the crotch post about the fixed axis between an extended position wherein the crotch post extends at an angle away from the tray and a retracted position wherein the crotch post is positioned to lie adjacent to the tray.

64. The tray assembly of claim 63, wherein the pivot post is molded to be integral with the crotch post.

65. The tray assembly of claim 63, wherein the tray includes a tray bottom molded to be integral with a mounting portion and the pivot posts engage the mounting portion.

66. The tray assembly of claim 65, wherein the crotch post is formed to include a notch in the front surface thereof.

67. The tray assembly of claim 63, wherein the crotch post includes a notch formed in a front surface thereof and positioned to receive the tray therein when the crotch post is in the retracted position.

68. The tray assembly of claim 63, wherein the tray includes a notch formed in a side surface thereof and positioned to receive the crotch post therein when the crotch post is in the retracted position.

69. A tray assembly comprising a tray including a tray bottom formed integral with a mounting portion and a crotch post engaging and cooperating with the mounting portion to move between an extended position wherein the crotch post extends at an angle away from the tray and a retracted position wherein the crotch post is positioned to lie adjacent to the tray.

70. The tray assembly of claim 69, wherein the crotch post pivots relative to the tray about a fixed axis.

71. The tray assembly of claim 70, wherein the crotch post includes a notch formed in a front surface thereof and positioned to receive the tray therein when the crotch post is in the retracted position.

72. The tray assembly of claim 70, wherein the tray includes a notch formed in a side surface thereof and positioned to receive the crotch post therein when the crotch post is in the retracted position.

73. A tray assembly comprising a tray and a crotch post coupled to the tray for pivotal movement about a fixed axis such that placement of the tray assembly on a flat surface causes the crotch post to automatically pivot about the fixed axis from a substantially vertical position to a substantially horizontal position.

74. A tray assembly comprising a tray, a crotch post, and means for mounting the crotch post to the tray for movement of the crotch post relative to the tray between an extended position wherein the crotch post extends at an angle away from the tray and a retracted position wherein the crotch post is adjacent to the tray, wherein the tray includes a top surface and a bottom surface, the crotch post includes a hip portion and a pivot post extending from the hip portion, and the mounting means includes a tab extending from the bottom surface and having a hole formed therein and the pivot post extends into the hole to allow the crotch post to pivot about a fixed axis defined by the pivot post.

75. The tray assembly of claim 74, wherein the tray includes an outward edge, an opposite inward edge, and opposite side edges extending between outward and inward edges and the crotch post is positioned to lie between the opposite side edges.

76. A tray assembly comprising a tray and a crotch post including at least one pivot post rotatably coupled to the tray to enable pivotal movement of the crotch post between an extended position wherein the crotch post extends at an angle away from the tray and a retracted position wherein the crotch post is adjacent to the tray, wherein the tray includes a hip portion having pivot posts that couple to the tray and the crotch post is formed to include a notch that receives a perimeter edge of the tray upon movement of the crotch post to the retracted position.

77. The tray assembly of claim 76, wherein the tray includes spaced apart tabs extending from a bottom surface of the tray to define a post-receiving cavity therebetween, the crotch post is positioned to lie within the cavity, and each pivot post is rotatably coupled to one of the tabs.

* * * * *